United States Patent [19]

Sasson

[11] 4,041,628

[45] Aug. 16, 1977

[54] APPARATUS FOR VISUALLY REGISTERING INDICIA

[76] Inventor: Eli Sasson, 605 N. Bedford, Beverly Hills, Calif. 90210

[21] Appl. No.: 676,786

[22] Filed: Apr. 14, 1976

[51] Int. Cl.[2] ..... G09D 3/06

[52] U.S. Cl. ..... 40/111; 40/70 R; 116/133

[58] Field of Search ..... 40/111, 113, 114, 115, 40/70 R, 70 A; 116/133, 121, 129 E, 129 F, 129 K

[56] References Cited

U.S. PATENT DOCUMENTS

| | | | |
|---|---|---|---|
| 801,887 | 10/1905 | Low | 40/114 |
| 1,756,600 | 4/1930 | Lee | 40/113 |
| 3,232,401 | 2/1966 | Jones | 116/133 X |
| 3,534,315 | 10/1970 | De Nicola | 116/133 X |
| 3,621,811 | 11/1971 | Hill | 116/133 X |

*Primary Examiner*—John F. Pitrelli
*Attorney, Agent, or Firm*—Huebner & Worrel

[57] ABSTRACT

Apparatus for visually registering information, which apparatus utilizes an outer adjustable member containing transparent indicia, which indicia will become visually distinct when said indicia is moved to overlie an inner fixed member and a color area thereon differing from the color surrounding said indicia.

5 Claims, 10 Drawing Figures

APPARATUS FOR VISUALLY REGISTERING INDICIA

BACKGROUND OF THE INVENTION

There have been various signs in the past available to record time and other information with regard to store openings and closings. There is the conventional clock with a pair of manually movable hands to designate when the store will be opened or closed. The same type of construction has been used by salesmen to indicate when they will return to their offices.

In addition, there are certain forms of indicia registering devices wherein there is a fixed back member and a rotatable front member having a window therein which can be moved to expose information printed on the fixed member.

With regard to calendars, there have been those type of perpetual calendar where magnets are used to draw the desired dates into proper alignment for registering, as well as a perpetual calender wherein the differing color for registry behind the indicia is movable, such as is contained in my copending U.S. patent application, Ser. No. 660,340, filed Feb. 23,1976.

SUMMARY OF THE INVENTION

It is an object of this invention to utilize an outer movable, preferably plastic, member of a color, and there is etched thereon indicia which is transparent. This member overlies a fixed member which contains on all but a portion of the surface a color corresponding to the color of the outer movable member. At a designated area on the fixed member, a distinct color differing from the other color of the fixed member is provided so that when the transparent indicia on the movable member is moved to overlie this differing color, the specific indicia can be visually read.

One of the objects of this invention is to utilize a circular fixed member and an outer rotatable cap member to overlie the same.

Another object of the invention is to provide a relatively small fixed member and an elongated movable member which may be moved horizontally or vertically in order to resister the specific indicia over the differing color.

Another object of this invention is to adapt the apparatus for such things as perpetual calendars, return signs for salesmen, store openings and closings, etc.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings, which are for illustrative purposes.

PREFERRED EMBODIMENTS OF THE INVENTION

Figure 1:
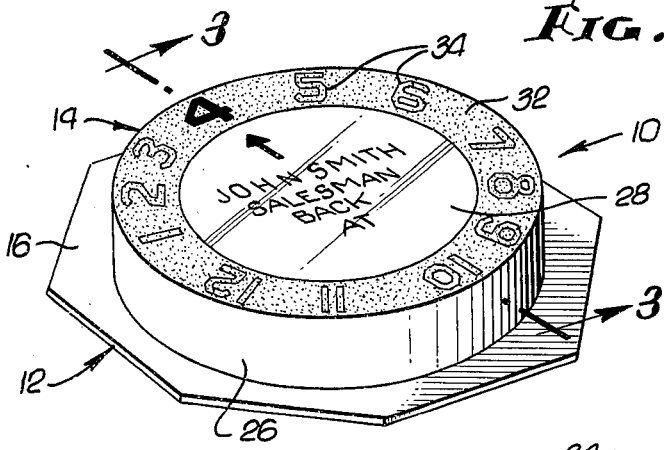
FIG. 1 is a perspective view of the completed apparatus for use as a sign by a salesman, etc., wherein the fixed and movable members are both circular.
Figure 2:
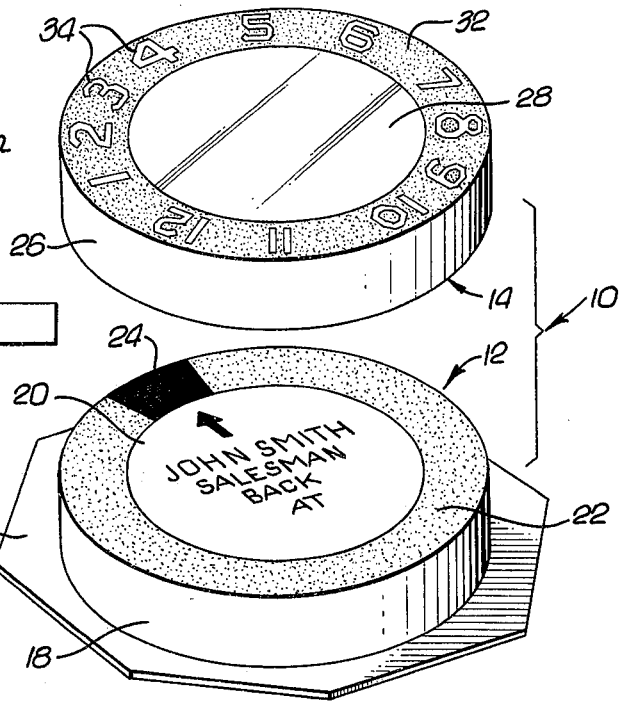
FIG. 2 is an exploded view of the apparatus, as shown in FIG. 1.
Figure 3:
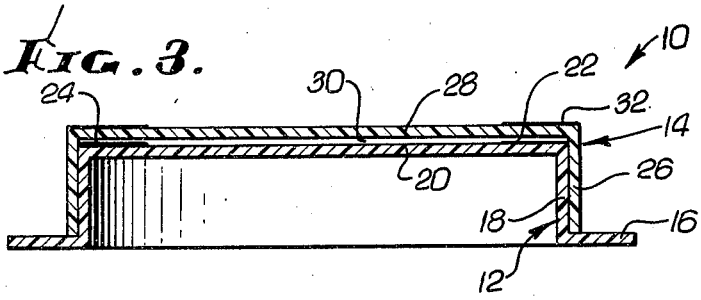
FIG. 3 is a cross-sectional view of the apparatus, taken on lines 3—3 of FIG. 1.

There is illustrated in FIGS. 1 through 3 the principle of this particular indicia registering apparatus, generally designated 10. The apparatus 10 includes a fixed member 12 and a movable member 14. The fixed member 12 preferably includes some form of base platform 16 and an upright annular wall 18 extending normal to the plane of the base 16. The wall 18 terminates in an upper, generally flat top surface 20.

The top surface 20 includes an annular band 22 of a color corresponding to a color to be described on the movable member 14. It should be realized that the band of color 22 may extend over the entire surface of the top 20 of the fixed member 12, or it may be silk-screened or otherwise placed upon the top 20 so that there is an internal section wherein specific indicia may be printed, such as seen in FIGS. 1 and 2.

In the particular embodiments of FIGS. 1 through 3, there is positioned on the annular color band 22 of the top surface 20, at a position that would approximate 12 o'clock on a clock, a color 24 area of a color distinct and different from the color band 22.

Turning now to the movable member 14, it is in the form of a cap and includes an upright wall 26, terminating in a top flat surface 28.

As can be seen in FIG. 3, the interior diameter of the annular wall 26 of the movable member 14 is constructed so as to be complementary with the exterior wall 18 to form a friction fit between the members 12 and 14, as best seen in FIG. 3. When the movable member 14 overlies the fixed member 12, the wall 26 thereof is generally longer than the wall 18 so that there is a space 30 between the respective top surfaces 20 and 28.

In the preferred embodiment of this invention, the top surface 28 of the movable member 14 is silk-screened forming an annular color band 32 of the same color and width as the color band 22. During the silk-screening process, there is however an etching which is employed whereby indicia 31, such as numbers, are formed on the surface 28 that are transparent.

In the construction of the fixed and movable members 12 and 14, a relatively inexpensive, thin plastic may be utilized, which is generally transparent and painted or silk-screened accordingly to prepare the solid band of color 22 and the interrupted band of color 32, which is broken or interrupted by the transparent indicia 34.

In order to assemble the completed apparatus 10, the movable member or cap 14 is positioned over the fixed member 12 so that the wall 26 fricitionally engages the wall 18 to retain the member 14 in position.

Once the unit is assembled, the movable member 14 may be rotated clockwise or counterclockwise until the indicia 34 comes into registry with and overlies the color area 24 which is different from the surrounding color of either the top 20 or 28. Because of the fact that the wall 26 frictionally grips the wall 18, no exterior light may pass within the space 30, and it becomes light tight or forms a light trap, and therefore the indicia which is not in registry with the color area 24 will not be distinctly visible, and in some cases not discernible. However, with the rotatable member 14 being moved to the position, such as shown in FIG. 1, where the indicia 34 is the "number 4," light will penetrate through the transparent indicia 34 to the distinctly different color area 24, whereby it is visually discernible by one looking at the apparatus.

Figure 4:
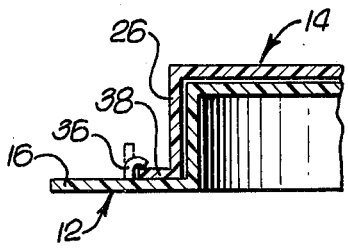
FIG. 4 is a cross-sectional view of the apparatus of FIG. 3 illustrating a modified form of retaining the movable member to the fixed member.

In FIG. 4, the modification of apparatus 10 resides in the fact that there is provided on base 16 a plurality of tabs 36 struck from the base 16, which are adapted to be pinned or bent over a flange 38 formed at the bottom of the wall 26 of the movable member 14. It can thus be seen that with a structure as illustrated in FIG. 4, several of these tabs 36 may be used to maintain the apparatus in assembled position. Additionally, with the use of tabs 36 it is not necessary to form the interior diameter of the wall 26 to a close tolerance with the wall 18 of the fixed member 12.

Figure 5:
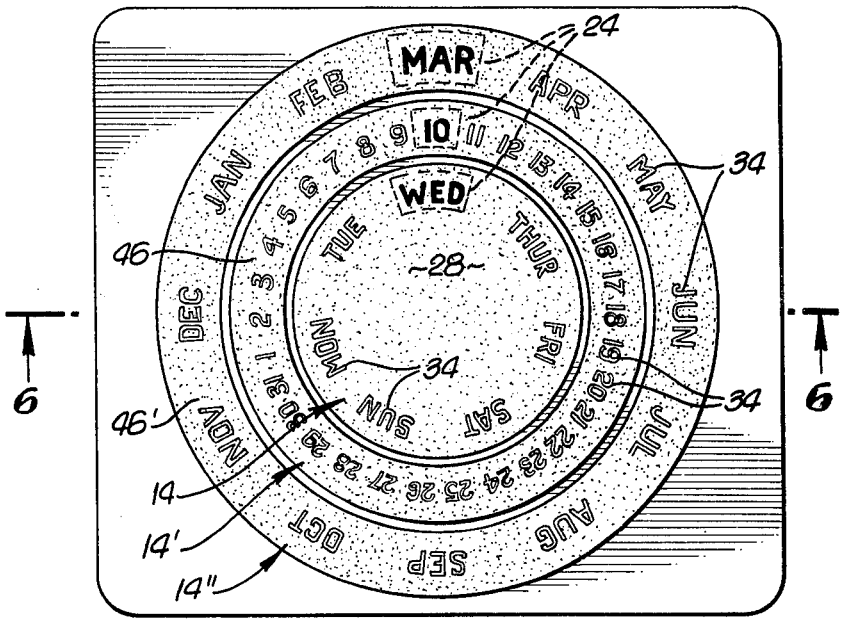
FIG. 5 is a top elevational view of a modified form of this invention showing three independently movable concentric members.
Figure 6:
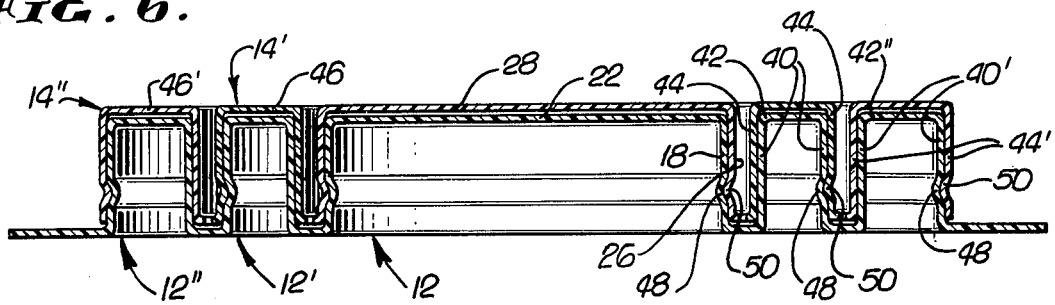
FIG. 6 is a cross-sectional view, taken on lines 6—6 of FIG. 5.

FIGS. 5 and 6 illustrates a modification or addition to the apparatus 10 of FIG. 1. Starting with the fixed member 12 the annular wall 18 and top surface 22 remain the same. Also the movable member 14 with the annular wall 26 and top surface 28 which overlies surface 22 are identical. However, the base 16 does not terminate but may continue and forms a pair of annular fixed members 12' and 12" each with spaced apart annular walls 40 and 40', respectively. Each of these sets of annular walls 40 and 40' are bridged at the top by flat top surfaces 42 and 42'. The top surfaces 22, 42 and 42' each have a color area 24 similar to that shown in FIG. 2.

Covering each of the fixed members 12' and 12" are movable members 14' and 14" each having a pair of annular walls 44 and 44' bridged by top flat surfaces 46 and 46' overlying top surfaces 42 and 42'. As with top 28, the tops 42 and 42' are appropriately prepared with indicia 34.

With the concentric ring arrangement it is preferable to align the color areas 24 one above the other, as illustrated in broken lines in FIG. 5, for registry of the indicia 34. As can be seen with each movable member 14, 14" and 14Δ as constructed, they may be rotated independently one from the other.

There is further shown in FIGS. 5 and 6 another means of retaining the movable members 14, 14" and 14" to the fixed members 12, 12' and 12". There is provided in the walls 18, 40 and 40' annular ridges or detents 48 and complementary annular ridges or detents 50 in walls 26, 44 and 44' so that the members may be held together yet allow rotation of the movable members 14, 14' and 14".

As can be seen in FIG. 5, the primary purpose of this modification is for use as a perpetual calendar, wherein one of the indicia registering apparatus will contain the month of the year, another one will contain the dates of the month, and the third, the days of the week.

While annular detents or grooves 48 and 50 are preferably utilized as shown in FIGS. 5 and 6, friction fit, such as shown in FIG. 3, may be utilized without departing from the spirit of the invention.

Figure 7:
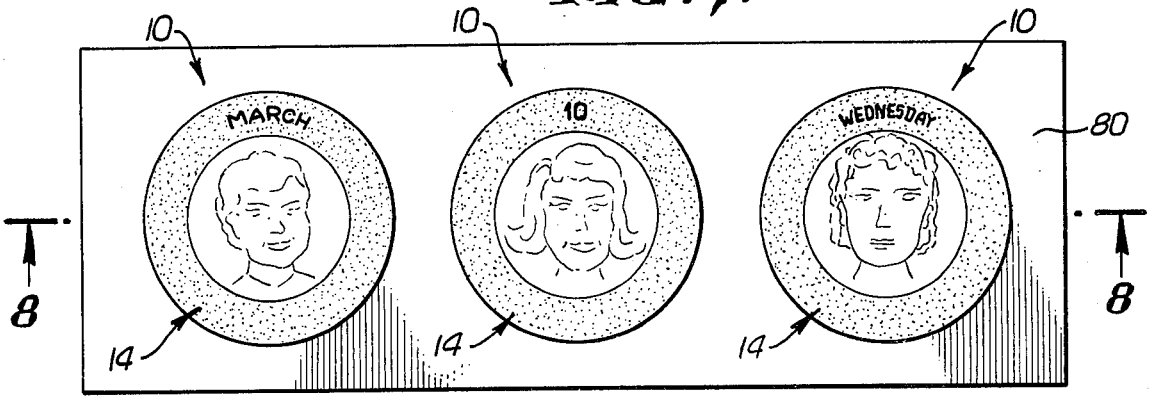
FIG. 7 is a modified form of this invention showing separate apparatus for the perpetual registration of dates, wherein a portion may be used for placing photographs, advertisements, etc.
Figure 8:
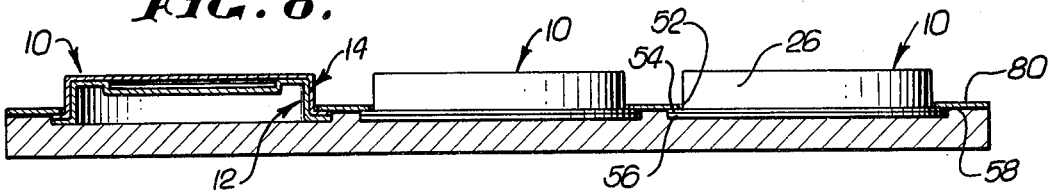
FIG. 8 is a cross-sectional view, taken on lines 8—8 of FIG. 7.

FIGS. 7 and 8 illustrate a further modification of the invention wherein there are a plurality of side by side indicia registering apparatus 10, wherein the movable member 14 contains indicia to register as a calendar, with the month of the year appearing on one apparatus, the date on another, and the day of the week on still another.

As can be seen the central portion of the top surface 28 may be used for the insertion of appropriate photographs, advertisements, or other material.

The only difference between the embodiments of FIGS. 7 and 8 over the preceding illustration is that each of the indicia registering apparatus 10 is mounted under a surface 80 which has been appropriately cut out forming an opening 52 slightly larger than the exterior of the upright wall 26. This surface 80 may be of decorative material, and in order to assemble the calendar, the assembled fixed and movable members 12 and 14 are mounted from the back or underside of the surface 80 and pushed outwardly so that flanges 54 and 56, having a larger diameter than the opening 52, will bear against the underside 58 of the surface 50, holding the apparatus appropriately in place but still, however, being rotatable to move to the designated month, day and date of the year.

Figure 9:
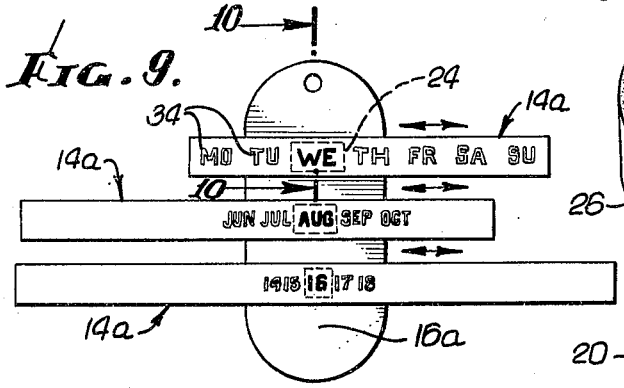
FIG. 9 is a modified form of perpetual calendar wherein instead of the outer movable member being rotatable, it is slideable.
Figure 10:
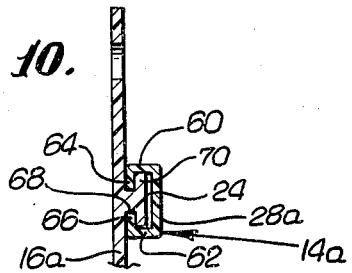
FIG. 10 is a view taken on lines 10—10 of FIG. 9.

The apparatus, as illustrated in FIGS. 9 and 10, in principle corresponds to those illustrated in the previous drawings, but instead of having a rotatable member 14, the movable member **14*a* can slide horizontally from right to left, as shown by the arrows, wherein the transparent indicia 34 will register with the different color area 24, as best seen in FIG. 10, which is fixed to a base 16*a*. The slideable member 14*a* is preferably elongated, includes a top surface 28*a*, a pair of opposed walls 60 and 62, each of the walls 60 and 62 including a tab or inturned flange 64 and 66 extending inwardly toward each other to a point where they terminate from each other in a narrow, elongated slot 68. A bracket or holder 70 extends from the base 16*a* to maintain the colored area 24', and when mounted the bracket 70 is within the slot 68 to allow the movable member 14*a*** to slide back and forth.

While the illustrations of FIGS. 9 and 10 show the movable member **14*a* as moving horizontally from left to right or right to left, it should be appreciated that the member 14*a* may be turned vertically with appropriate correction in the positioning of the indicia 34 so that the movable member 14*a* may slide up and down, and the indicia being caused to stop over the different color area 24** will assure a visual registration of the same.

As previously discussed, the color of the outer member 14 and the stop surface of the inner fixed member 12 should be of a corresponding color. It has been found that black would be an appropriate color, whereby light can be absorbed. As for the different color area 24, it has also been found that in order to visually stimulate the eye of the viewer and assure a proper reading, a distinctly different color should be utilized, and preferably a color that gives the impression of luminescence.

Further, while the preferred material for utilization of any of the indicia registering apparatus which has been described above is plastic, it should be realized that any type of material can be utilized as long as the top surface 28 of the movable member 14 can be processed whereby the indicia 34 is transparent and the surrounding area of a color corresponds to the color band 22 of the top surface 20 of the fixed member 12.

The invention and its attendant advantages will be understood from the foregoing description and it will be apparent that various changes may be made in the form, construction and arrangements of the parts of the invention without departing from the spirit and scope thereof or sacrificing its material advantages, the arrangements hereinbefore described being merely by way of example. I do not wish to be restricted to the specific forms shown or uses mentioned except as defined in the accompanying claims, wherein various portions have been separated for clarity of reading and not for emphasis.

I claim:

1. For use in perpetual calendars and other uses to visually register indicia apparatus having rotatable members whereby relative rotation of the members visually registers indicia on one of the members, comprising:

a circular member having a supporting wall and a first top surface bridging the area between said wall, said first top surface having an area of a first color, and interposed in said first color and of a lesser area, a second color distinct from said first color, the area of said first color extending at least in a peripheral band around said first top surface spaced by said second color, a circular cap rotatable on and overlying and surrounding the top and wall of the circular member, said cap having a second top surface having an area of said first color overlying said area of said first color on said circular member and extending at least in a peripheral band, there are a plurality of said circular members and said caps concentrically arranged, said plurality of circular members are joined and said caps are fitted to be independently rotated on respective circular members, and peripherally arranged transparent indicia formed in said second top surface in said area of said first color thereon whereby relative rotation of said members will cause a portion of said indicia to overlie and register with said second area of color to visually direct attention to said portion of said indicia the respective second areas of color are radially aligned.

2. The invention according to claim 1, wherein:

the indicia on respective caps are months of the year, numbers, and days of the week.

3. The invention according to claim 1 in which:

said top surface on said cap is opaque in areas of other than said indicia, and said top surface of said circular member is opaque, said fitting of said cap wall with said circular member wall being lightproof to provide with said opaque areas, a lightprcof area between said cap and circular member surrounding said first color area.

4. The invention according to claim 1 in which:

said cap top and said circular member top being closely juxtaposed.

5. The invention according to claim 1 in which:

said portion of indicia in register with said second area of color is a single separate and distinct portion of the total peripherally arranged indicia.

* * * * *